United States Patent [19]

Benoit et al.

[11] Patent Number: 4,747,815

[45] Date of Patent: May 31, 1988

[54] COLLECTION OF BAGS AND METHOD OF PREPARING THE SAME

[75] Inventors: Gordon L. Benoit, Macedon; James R. Gavin, Pittsford; Ned R. Pendleton, Macedon; William Randolph, Marion, all of N.Y.

[73] Assignee: Mobil Oil Corporation, New York, N.Y.

[21] Appl. No.: 931,885

[22] Filed: Nov. 17, 1986

Related U.S. Application Data

[63] Continuation of Ser. No. 729,832, May 2, 1985, abandoned.

[51] Int. Cl.[4] ..... B65B 1/14; B65D 30/02

[52] U.S. Cl. ..... 493/194; 206/554; 206/390; 383/37; 493/198; 493/230; 493/462; 493/963

[58] Field of Search ..... 156/257, 263, 230, 493; 206/390, 494, 554; 383/17, 37; 493/199, 210, 223, 224, 227, 230, 233, 238, 239, 361, 363–365, 920, 935, 198, 462, 963, 194

[56] References Cited

U.S. PATENT DOCUMENTS

| | | | |
|---|---|---|---|
| 3,094,083 | 6/1963 | Weeks | 383/37 |
| 3,254,828 | 6/1966 | Lerner | 383/37 |
| 3,590,990 | 7/1971 | Rubin | 206/390 |
| 3,682,051 | 8/1972 | Sengewald | 493/230 |
| 4,046,257 | 9/1977 | Lehmacher | 206/554 |
| 4,285,681 | 8/1981 | Walitalo et al. | 383/37 |
| 4,306,656 | 12/1981 | Dahlem | 206/390 |
| 4,500,307 | 2/1985 | Bridgeman | 493/230 |

*Primary Examiner*—Jimmy G. Foster

*Attorney, Agent, or Firm*—A. J. McKillop; M. G. Gilman; J. P. O'Sullivan, Sr.

[57] ABSTRACT

The present invention relates to a collection of ultra-thin bags and a collection of bags per se wherein said bags are made by providing two separated thermoplastic films; forming transversely across each separated film, lines of weakness extending from one edge of each film to the other, with each line spaced from the next a bag length distance apart; bringing the films together in face-to-face relationship with the lines of weakness across one film in registration with those of the other films; sealing the films transversely along lines parallel with and immediately adjacent to the lines of weakness; slit-sealing the film layers at one or more bag width intervals to complete individual but interconnected bag structures; and collecting each strip of interconnected bags into a volumetrically efficient form.

5 Claims, 2 Drawing Sheets

FIG. 2
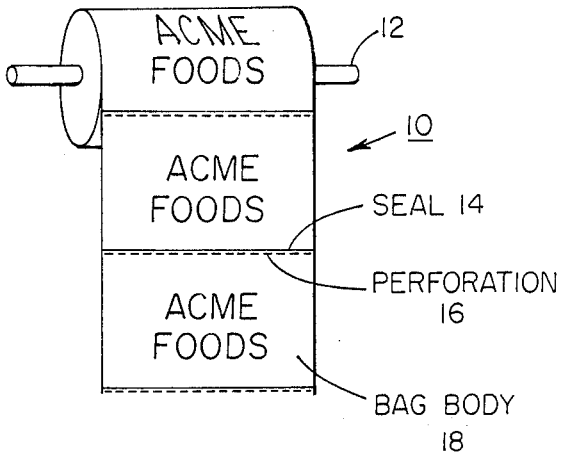
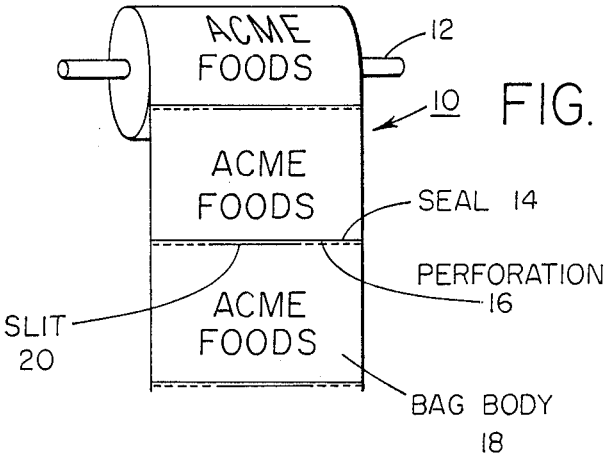
FIG. 3
FIG. 4
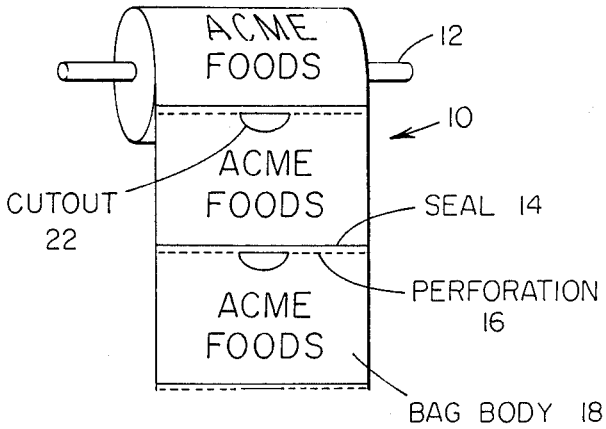

COLLECTION OF BAGS AND METHOD OF PREPARING THE SAME

This is a continuation of copending application Ser. No. 729,832, filed on May 2, 1985, abandoned.

The present invention relates to a collection of thin thermoplastic bags and a method and system for preparing the same.

The bags of the present invention are of the ultra thin type employed, for example, in the produce department of supermarkets to facilitate in the handling, weighing and protecting of fresh produce and the like. Bags of this type usually are of a plastic film, e.g. polyethylene, having a film thickness of anywhere from about 0.15 to 0.5 mils. The bags are of simple construction, usually comprising a collapsed tube sealed at the bottom and open at the opposite end. Such bags are commonly provided as interconnected along a perforation line and a plurality of the same convolutely wound into a roll. In use the customer grasps one bag and tears it free from the roll along the perforation line.

A vexing problem associated with such a bag is the difficulty in determining which end of the bag is the open end and then difficulty in separating the two films once the open end is determined. Because of the thin, flimsy nature of the film the bag tends to remain collapsed with the film in somewhat of a blocked condition. In addition, there is difficulty in separating the two ends of the films which constitute the mouth of the bag because of the lack of air between the films. This is a natural consequence of the manufacturing process.

In a typical process, ultra thin gauge film, in a collapsed tubular form, is presented for conversion into a finished roll of bags. The collapsed tube can be made into one or a plurality of simultaneously fashioned rolls of bags. As an example, the collapsed tube can be made into five rolls of bags. The collapsed tube is presented to means which will form transverse seals across the entire tube at bag length spaced intervals. Following this, parallel to the seals and closely spaced therefrom is formed a line of perforations through both layers of the collapsed tube. Thereafter, a slit sealing means longitudinally separates and seals the collapsed tube into individual side sealed webs of mouth to bottom interconnected strips of bags. These bags are then convolutely rolled into the finished product. Each roll then is ready for positioning on a simple mandrel means in the produce department of a store, thus, accommodating individual bag dispensing to the customer. Such bags have become a necessary packaging item in produce departments. There is, however, a need to improve and facilitate the handling and opening of the bags.

Its an object of the invention to present a collection of thin plastic bags having an easy to open bag mouth.

It is another object of the invention to present a process for forming a collection of ultra thin produce bags having an easy to open bag mouth.

It is still another object of the present invention to present an improved system for the formation of such a collection of ultra thin plastic film bags.

SUMMARY OF THE INVENTION

The present invention is concerned with a method for preparing an improved ultra thin gauge produce bag and a convolutely wound roll of the same. As indicated above, present day produce bags are difficult to open at the bag mouth because of the way in which they are manufactured. During manufacture two extremely thin films are in contacting face-to-face relationship as a perforating means forms a line of perforations therein. This action occurs at fairly high speed and usually under some conditions of heat. The piercing action of the perforating means causes an intermingling type contact between the pierced face-to-face contacting films. If the temperature is too high or if the blades used are dull, this action also causes a degree of blocking between the films along the line of perforation. As a result, in attempting to open the bag, the customer must first determine which end of the bag is the bag mouth and then must carefully separate the two blocked and intermingled films to gain access to the inside of the bag.

This problem has been overcome by forming the bag mouth as a result of performing individual, spacially separated operations on separated films and, thereafter, bringing the two films together to finish the operations necessary to complete the bag. By this process the tear-off region of the bag cannot result in an intermingling of the films. Since the point of severance is formed while the films are remote from one another, they do not have a chance to become intermingled or blocked.

Therefore, in a convolutely wound collection of mouth-to-bottom interconnected thermoplastic film bags wherein said bags are separable along two lines of weakness which are in registration across the front and rear walls of the bag, the improvement herein comprises forming the two lines of weakness while the front and rear wall panels are remote and out of contact with one another and, thereafter, bringing the panels and lines into registration and completing formation of the bags. By this technique, each line of weakness will be truly unique.

The method of preparing the collection of ultra thin bags comprises:

(a) providing two separated thermoplastic films, each film being of at least approximately the same width and suitable for the formation of one or more lengths of interconnected bags;

(b) forming, transversely across each film, lines of weakness extending from one edge of each film to the other, with each line spaced from the next a bag length distance apart;

(c) bringing said films together in face to face relationship with the lines of weakness across one film in registration with those of the other film;

(d) sealing the films transversely along lines parallel with and immediately adjacent to the lines of weakness;

(e) slit sealing the film layers at one or more bag width intervals to complete individual but interconnected bag structures; and (f) collecting each strip of interconnected bags into a volumetrically efficient form.

BRIEF DESCRIPTION OF THE DRAWING

FIG. 2 is a perspective view of one form of interconnected bags of the invention.

FIG. 3 is a perspective view of another form of interconnected bags of the invention.

FIG. 4 is a perspective view of still another form of interconnected bags of the invention.

DETAILED DESCRIPTION OF THE INVENTION

Figure 1:
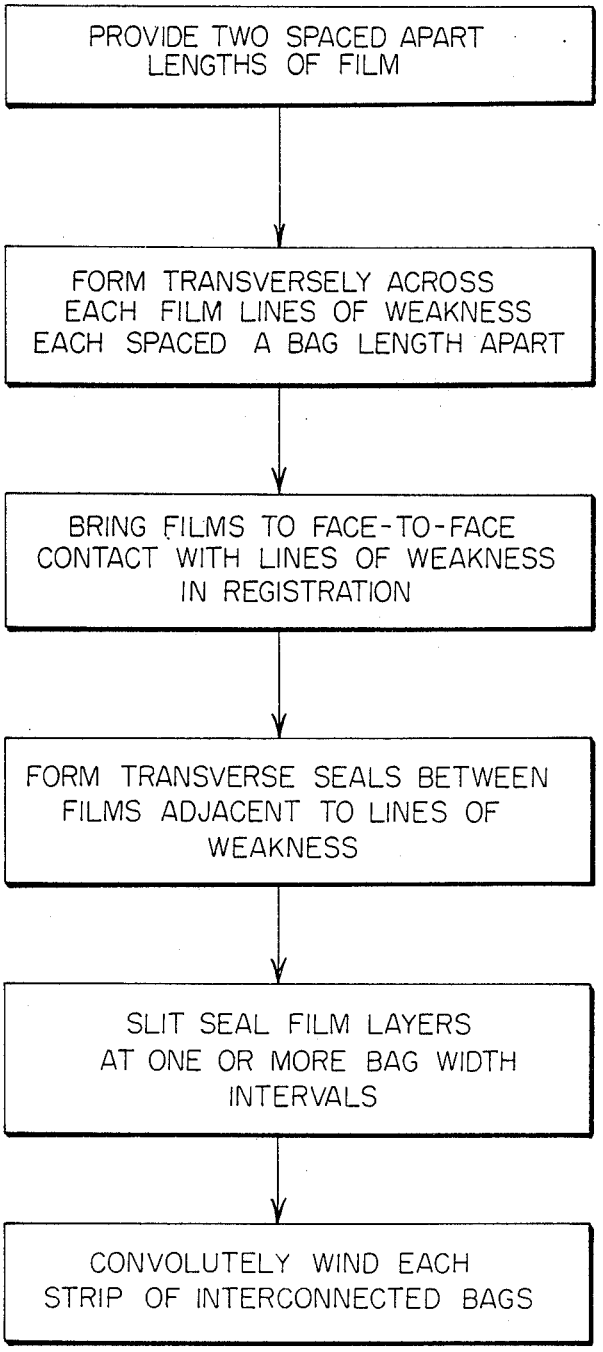
FIG. 1 is a block flow diagram detailing the process of this invention.

It is to be understood that the lines of weakness can be varied in character. For example, the lines of weakness can be lines of perforations. These perforations can be a line of holes where each hole is separated by a space of film. The shape of the hole can be regular or irregular, punched, or merely a slit. The line of perforations can be any combination of interrupted orifices in an at least generally straight line across the face of the film. The lines of weakness across one film which is thereafter brought into registration with the lines of weakness across the other film can be exactly the same kind of line of weakness or of a different structural type. In either case the lines of weakness will be different and not entangled with one another. An advantage of having different shaped lines of weakness in each film of the two films making up the bag structures is an ease in opening the bag mouth because the character of the lines of weakness are different. For example, one line of the bag mouth can be formed of a string of uniform dot perforations whereas the line of weakness in the opposite panel of the mouth can be a series of comparatively long dashes with a central elongated portion removed. The central, removed elongated portion would accommodate the user in tearing the bag free of a roll of films and at the same time providing a finger access or accommodating point to open the flimsy bag.

In FIG. 1 there is shown a flow diagram sequence of the process of the present invention. Step 1, which provides for two spaced apart lengths of film, can be accomplished by any means. For example, as a film is made by the blown film technique, the resulting tubular film can be split longitudinally into two halves, thus providing the two spaced apart lengths of film. Alternatively, a single wide roll of film can be longitudinally severed into two lengths of film. Two separate feed rolls of film of approximately the same width can also be positioned so that the length of film is postured in a spaced apart relationship.

In Step 2, there are formed transverely across each film, lines of weakness which are each spaced a bag length apart. As indicated above, the lines of weakness in one length of film can be the same or different geometrically. Referring to FIGS. 2, 3 and 4, these lines of weakness are the perforations 16 which are represented as being punctured holes or orifices in a straight line across the film. In every case, one side of the bag will have a series of holes or perforations of the type illustrated. FIG. 3 shows that the front face of the bag has a series of perforations 16 which is interrupted in the center by a slit 20 which occupies for example approximately $\frac{1}{3}$ of the width of the bag. A variation of this is shown in FIG. 4 where perforations 16 are interrupted by a cut-out 22. In both instances the slit 20 and the cut-out 22 accommodates the locating of the bag mouth end of the bag and also accommodates the opening of the bag mouth. This effectively solves the problem presently existing in most prior art bags of the type referenced.

Returning to Step 3 of the process, after the appropriate lines of weakness are formed in each bag length, the two films are brought into face-to-face contact with the lines of weakness being positioned in registration. Following this, by Step 4, there are formed transverse seals between the films immediately adjacent the lines of weakness as shown at 14 in FIGS. 2, 3 and 4. This seal ultimately will form the closed bottom of the bags. Following this, at Step 5, the width of the films is slit-sealed longitudinally at one or more bag width intervals by any slit-seal means to continuously longitudinally slit and seal through the edges of the film so as to form, in each strip of interconnected bags, the side walls of the bags. In lengths of film, for example, approximately 36 inches wide five continuous strips of 6 inch wide bags can be obtained in this manner. Thereafter, in Step 6, the separated strips of interconnected bags are convolutely wound onto a suitable mandrel, for example, one made of either a cardboard tube or a plastic tube. The rolls of bags are then ready for use, for example, in a produce department. The final result is a convolutely wound collection of bags which are easy to sever from the roll and are easy to open at the bag mouth. The bag rolls 10 shown in the drawing can be made up of any number of bag bodies 18, for example 50, 100, 500 or more.

Bags of the structures described can be formed by employing any suitable thermoplastic material, for example, polyolefins. In employing the term "polyolefins" it is used generically to include all forms of the polymer species, including, for example, low density polyethylene, linear low density copolymers of ethylene and another olefin, high density polyethylene, mixtures and blends of the same, and other monomer counterparts, etc. Thermoplastic coated paper stock is also contemplated. The bag film can be of any gauge, for example, from about 0.15 to about 0.75 mils or thicker.

What is claimed is:

1. A method of preparing a collection of thin thermoplastic interconnected bags comprising:
   (a) providing two separated thermoplastic films, each film being less than 0.75 mils and of at least approximately the same width and of a length suitable for the formation of one or more lengths of interconnected bags;
   (b) forming, transversely across each film, lines of weakness extending from one edge of each film to the other, with each line spaced from the next a bag length distance apart;
   (c) bringing said films together in face-to-face relationship with the lines of weakness across one film in registration with those of the other film;
   (d) sealing the films transversely along lines parallel with and immediately adjacent to the lines of weakness;
   (e) slit-sealing the film layers at one or more bag width intervals to complete individual but interconnected bag structures; and
   (d) collecting each strip of interconnected bags into a volumetrically efficient form.

2. The method of claim 1 wherein the lines of weakness in one film differs geometrically from the lines of weakness in registration therewith of the other film.

3. The method of claim 2 wherein the geometry of the line of weakness in one film of the bag includes a finger accommodating region.

4. The method of claim 1 wherein said interconnected bags are collected in a convolutely wound roll.

5. The method of claim 1 wherein each strip of interconnected bags is collected into an alternately folded bag arrangement to form a bad stack.

* * * * *